US008424338B2

(12) United States Patent
Yamada et al.

(10) Patent No.: US 8,424,338 B2
(45) Date of Patent: Apr. 23, 2013

(54) VAPOR COMPRESSION REFRIGERATING CYCLE APPARATUS WITH AN EJECTOR AND DISTRIBUTOR

(75) Inventors: Etsuhisa Yamada, Kariya (JP); Haruyuki Nishijima, Obu (JP); Gouta Ogata, Nisshin (JP); Mika Gocho, Obu (JP); Kenta Kayano, Kariya (JP)

(73) Assignee: Denso Corporation, Kariya (JP)

( * ) Notice: Subject to any disclaimer, the term of this patent is extended or adjusted under 35 U.S.C. 154(b) by 477 days.

(21) Appl. No.: 12/380,791

(22) Filed: Mar. 4, 2009

(65) Prior Publication Data

US 2009/0229305 A1 Sep. 17, 2009

(30) Foreign Application Priority Data

Mar. 13, 2008 (JP) ..... 2008-064666

(51) Int. Cl.
*F25B 1/06* (2006.01)

(52) U.S. Cl.
USPC ..... 62/500; 62/512

(58) Field of Classification Search ..... 62/500, 62/512, 525, 526
See application file for complete search history.

(56) References Cited

U.S. PATENT DOCUMENTS 2,803,116 A * 8/1957 Tilney ..... 137/14
3,701,264 A * 10/1972 Newton ..... 62/191
7,254,961 B2 * 8/2007 Oshitani et al. ..... 62/500
7,513,128 B2 * 4/2009 Yamada et al. ..... 62/500
7,690,218 B2 * 4/2010 Ikegami et al. ..... 62/500
7,841,193 B2 * 11/2010 Nishida et al. ..... 62/170
2002/0000095 A1 1/2002 Takeuchi et al.
2006/0266072 A1 11/2006 Takeuchi et al.
2007/0000262 A1 1/2007 Ikegami et al.
2007/0028630 A1 2/2007 Yamada et al.
2007/0039350 A1 * 2/2007 Takeuchi et al. ..... 62/500

(Continued)

FOREIGN PATENT DOCUMENTS

CN 1892150 1/2007
JP 2001-153473 6/2001

(Continued)

OTHER PUBLICATIONS

Office Action dated Mar. 23, 2010 in Japanese Application No. 2008-064666.

(Continued)

*Primary Examiner* — Cheryl J Tyler
*Assistant Examiner* — Melanie Phero
(74) *Attorney, Agent, or Firm* — Harness, Dickey & Pierce, PLC

(57) ABSTRACT

A vapor compression refrigerating cycle apparatus includes a compressor, a radiator, first and second throttle devices, a flow distributor, an ejector, a suction passage, and first and second evaporators. The flow distributor separates refrigerant decompressed through the first throttle device into a first passage and a second passage. The first passage is in communication with a nozzle portion of the ejector. The second passage is in communication with a suction portion of the ejector through the suction passage. The second throttle device and the second evaporator are disposed on the suction passage. The flow distributor is configured to be capable of adjusting a ratio of a flow rate of refrigerant passing through the second passage to a flow rate of refrigerant passing through the first passage in accordance with a heat load of at least one of the radiator, the first evaporator and the second evaporator.

17 Claims, 4 Drawing Sheets

U.S. PATENT DOCUMENTS

| | | | | |
|---|---|---|---|---|
| 2007/0163294 | A1* | 7/2007 | Aung et al. | 62/500 |
| 2007/0180852 | A1 | 8/2007 | Sugiura et al. | |
| 2008/0000263 | A1* | 1/2008 | Oomura et al. | 62/525 |
| 2009/0095013 | A1 | 4/2009 | Ikegami et al. | |

FOREIGN PATENT DOCUMENTS

| | | |
|---|---|---|
| JP | 2003-014318 | 1/2003 |
| JP | 2004-116807 | 4/2004 |
| JP | 2007-023966 | 2/2007 |
| JP | 2007-162962 | 6/2007 |
| JP | 2008-008591 | 1/2008 |

OTHER PUBLICATIONS

Office Action dated Jun. 11, 2010 in Chinese Application No. 200910126518.9.

* cited by examiner

VAPOR COMPRESSION REFRIGERATING CYCLE APPARATUS WITH AN EJECTOR AND DISTRIBUTOR

CROSS REFERENCE TO RELATED APPLICATION

This application is based on Japanese Patent Application No. 2008-64666 filed on Mar. 13, 2008, the disclosure of which is incorporated herein by reference.

FIELD OF THE INVENTION

The present invention relates to a vapor compression refrigerating cycle apparatus having an ejector as a refrigerant decompressing and circulating device.

BACKGROUND OF THE INVENTION

In a vapor compression refrigerating cycle apparatus, it is known to employ an ejector as a decompressing device for decompressing refrigerant, which has been compressed into a supercritical state by a compressor and cooled through a radiator. The ejector is, for example, described in JP-A-2004-116807.

The ejector has a nozzle portion that converts pressure energy of the refrigerant flowing out from the radiator into velocity energy, thereby to isoentropically decompress and expand the refrigerant. Further, the ejector draws gas-phase refrigerant from in an evaporator by means of a high-velocity jet flow of refrigerant from the nozzle portion, and converts the velocity energy into pressure energy through a diffuser while mixing the drawn refrigerant with the refrigerant jetted from the nozzle portion, thereby to increase pressure of the refrigerant. By the increase in pressure of the refrigerant, power of the compressor can be reduced, and further a coefficient of performance (COP) of the refrigerating cycle apparatus can be improved.

In the ejector described in JP-A-2004-116807, an inner surface of the nozzle portion, which provides a refrigerant passage, is a smoothly curved surface without having corners, so as to facilitate the flow of the refrigerant by reducing occurrence of swirl flow and the like. Thus, efficiency of the ejector improves.

SUMMARY OF THE INVENTION

In a vapor compression refrigerating cycle apparatus having an ejector, it is difficult to sufficiently improve the COP due to a change in heat load of the refrigerating cycle apparatus. For example, as shown in FIGS. 6A and 6B, if the refrigerant is in a gas and liquid two-phase condition at an inlet of a nozzle portion of an ejector, pressure energy as input energy of the ejector is small due to the change in heat load, as compared with a case where the refrigerant is in a supercritical condition or a transitional critical condition at the inlet of the nozzle portion of the ejector. With this, the nozzle efficiency is likely to be reduced, and the increase in pressure by the ejector is likely to be reduced. Thus, it is difficult to sufficiently achieve the improvement of the COP of the refrigerating cycle apparatus.

The present invention is made in view of the foregoing matter, and it is an object of the present invention to provide a vapor compression refrigerating cycle apparatus capable of improving the COP by ensuring an effect of an increase in pressure by an ejector even if a heat load of the refrigerating cycle apparatus is changed.

According to an aspect of the present invention, a vapor compression refrigerating cycle apparatus includes a compressor, a radiator, a first throttle device, a flow distributor, an ejector, a first evaporator, a suction passage, a second throttle device, and a second evaporator. The compressor draws and compresses refrigerant. The radiator radiates heat of high-pressure refrigerant discharged from the compressor. The first throttle device decompresses refrigerant discharged from the radiator to generate gas and liquid phase refrigerant. The flow distributor has a first passage and a second passage and separates the gas and liquid phase refrigerant discharged from the first throttle device into the first passage and the second passage. The ejector includes a nozzle portion, a suction portion and a pressure-increase portion. The nozzle portion is in communication with the first passage and decompresses and expands refrigerant passing through the first passage. The suction portion draws refrigerant by a jet flow of refrigerant from the nozzle portion. The pressure-increase portion mixes refrigerant drawn from the suction portion with the refrigerant jetted from the nozzle portion and increases pressure of refrigerant. The first evaporator evaporates refrigerant discharged from the ejector and discharges evaporated refrigerant toward the compressor. The suction passage leads refrigerant passing through the second passage to the suction portion of the ejector. The second throttle device is disposed on the suction passage and decompresses and expands refrigerant passing through the suction passage. The second evaporator is disposed on the suction passage downstream of the second throttle device and evaporates the refrigerant passing through the suction passage. Further, the flow distributor is configured to be capable of adjusting a ratio of a flow rate of the refrigerant passing through the second passage to a flow rate of the refrigerant passing through the first passage in accordance with a heat load of at least one of the radiator, the first evaporator and the second evaporator.

Accordingly, since the flow rate of the refrigerant flowing into the nozzle portion of the ejector is adjusted in accordance with the heat load, pressure energy as ejector input energy can be adjusted. As such, it is possible to appropriately ensure an increase in pressure by the ejector. Therefore, ejector efficiency is improved, and hence the COP of the refrigerating cycle apparatus is improved.

For example, the flow distributor is configured to be capable of adjusting dryness of the refrigerant of the first passage to be smaller than dryness of the refrigerant of the second passage in a first load condition where the heat load is lower than a predetermined load. In general, an increase in pressure by the ejector increases as a ratio of a flow rate of the refrigerant drawn into the suction portion to a flow rate of the refrigerant flowing into the nozzle portion reduces. In the first load condition, a flow rate of the refrigerant circulating through the refrigerating cycle apparatus is reduced, and thus input energy applied to the ejector is reduced. As a result, the increase in pressure by the ejector is reduced. Considering such a circumstance, since the dryness of the refrigerant of the first passage is adjusted smaller than the dryness of the refrigerant of the second passage in the first load condition, the flow rate of liquid-phase refrigerant passing through the first passage is increased. Therefore, the flow rate ratio is reduced, and hence the increase in pressure by the ejector is increased. Accordingly, even in the first load condition, ejector efficiency is sufficiently maintained and the increase in pressure is ensured. As a result, the COP of the refrigerating cycle apparatus improves.

In a second load condition where the heat load is higher than the predetermined load, for example, the dryness of the refrigerant of the first passage is adjusted larger than the dryness of the refrigerant of the second passage. In the second load condition, the flow rate of the refrigerant circulating through the refrigerating cycle apparatus is increased. If the flow rate of the refrigerant flowing in the nozzle portion is excessively increased, expansion of the refrigerant in the nozzle portion is likely to be insufficient. Thus, the nozzle efficiency is reduced, and energy recovery is reduced. As a result, input energy of the ejector reduces. Considering such a circumstance, since the dryness of the refrigerant of the first passage is adjusted larger than the dryness of the refrigerant of the second passage in the second load condition, the flow rate of the liquid-phase refrigerant passing through the first passage is reduced and thus the refrigerant can be appropriately expanded in the nozzle portion. As such, the nozzle efficiency improves. With this, the increase in pressure by the ejector is ensured and the COP of the refrigerating cycle apparatus is improved.

BRIEF DESCRIPTION OF THE DRAWINGS

Other objects, features and advantages of the present invention will become more apparent from the following detailed description made with reference to the accompanying drawings, in which like parts are designated by like reference numbers and in which.

DETAILED DESCRIPTION OF EXEMPLARY EMBODIMENTS (First Embodiment)

Figure 1:
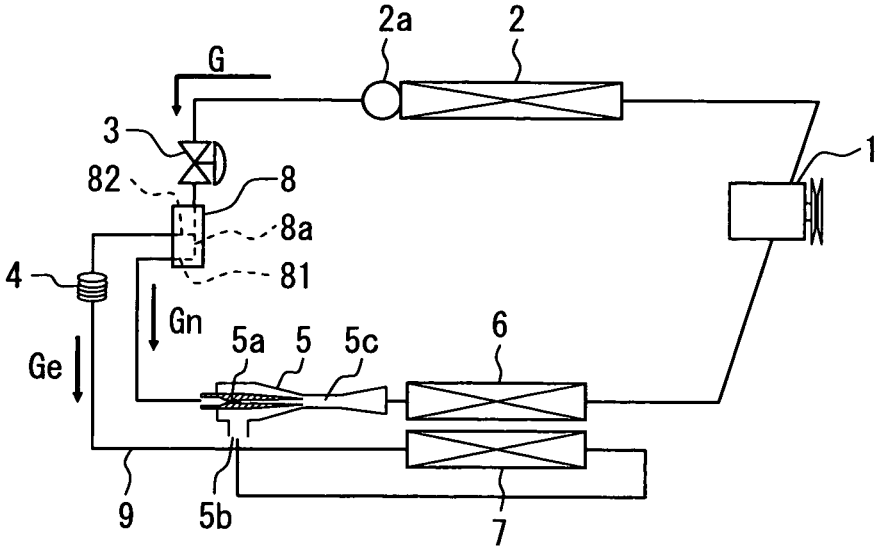
FIG. 1 is a schematic block diagram of a vapor compression refrigerating cycle apparatus according to a first embodiment of the present invention.

A first embodiment of the present invention will now be described with reference to FIGS. 1 to 5. FIG. 1 shows a vapor compression refrigerating cycle of the first embodiment. The vapor compression refrigerating cycle apparatus is, for example, mounted in a vehicle for an air conditioner.

The vapor compression refrigerating cycle apparatus generally includes a compressor 1, a radiator 2, a receiver 2*a*, a first throttle device 3, a flow distributor 8, an ejector 5, a first evaporator 6, a second evaporator 7 and a second throttle device 4. The compressor 1, the radiator 2, the receiver 2*a*, the first throttle device 3, the flow distributor 8, the ejector 5 and the first evaporator 6 are connected through refrigerant pipes in a form of loop. The refrigerating cycle apparatus further has a suction passage 9 diverging from the flow distributor 8 and connecting to the ejector 5. The second throttle device 4 and the second evaporator 7 are disposed on the suction passage 9. An operation of the compressor 1 is controlled by a control unit (not shown).

The compressor 1 is a fluid device and is driven by an engine of a vehicle through an electromagnetic clutch (not shown) and a belt (not shown). The compressor 1 draws refrigerant flowing out from the first evaporator 6 and compresses the refrigerant into a high temperature, high pressure condition. The compressor 1 further discharges the high temperature, high pressure refrigerant toward the radiator 2. The compressor 1 is, for example, a swash plate compressor, which is capable of varying the discharge capacity in accordance with a control signal inputted to an electromagnetic capacity control valve from the control unit.

For example, the compressor 1 can continuously vary the discharge capacity between 100% and approximately 0% by adjusting pressure of a swash plate chamber thereof. When the discharge capacity is reduced to appropriately 0%, the compressor 1 is substantially in a non-operated condition. In this case, the compressor 1 can be configured as a clutchless structure in which a rotation shaft of the compressor 1 is normally connected to the engine through a pulley and a V-belt.

The radiator 2 is a heat exchanger performing heat exchange between the high pressure refrigerant discharged from the compressor 1 and air, thereby to cool the high pressure refrigerant. For example, the air is outside air introduced from an outside of a passenger compartment of the vehicle and is forcibly applied to the radiator 2, such as by a blower (not shown).

The receiver 2*a* is disposed at a refrigerant discharge side of the radiator 2. The receiver 2*a* separates the refrigerant, which has been cooled through the radiator 2, into a gas-phase refrigerant and a liquid-phase refrigerant. The receiver 2*a* discharges only the liquid-phase refrigerant toward the first throttle device 3. For example, the receiver 2*a* is integrated with the radiator 2.

The first throttle device 3 is, for example, an expansion valve and decompresses the high pressure refrigerant discharged from the radiator 2 and the receiver 2*a*. The expansion valve 3 is, for example, a temperature sensing-type expansion valve in which an opening degree of a valve is controlled in accordance with the temperature of refrigerant discharged from the first evaporator 6.

The flow distributor 8, for example, has a generally block shape, such as a cube shape or a rectangular shape. The flow distributor 8 is formed with a first passage 81 and a second passage 82 therein. The flow distributor 8 distributes the refrigerant, which has been decompressed through the expansion valve 3, to the first passage 81 and the second passage 82.

The flow distributor 8 is further formed with a base passage 8*a* therein. The base passage 8*a* extends in an up and down direction inside of the flow distributor 8. The first passage 81 extends from a lower end of the base passage 8*a*, which is opposite to the expansion valve 3, in a horizontal direction. The second passage 82 extends from a portion of the base passage 8*a* in the horizontal direction, the portion being located between the lower end and an upper end of the base passage 8*a*. Thus, the second passage 82 is located higher than the first passage 81, for example.

The flow distributor 8 has a self control function for controlling a distribution quantities of the refrigerant to the first passage 81 and the second passage 82, such as a nozzle flow rate Gn and a suction flow rate Ge, by a centrifugal force, gravity, an inertial force and the like of the refrigerant in accordance with a flow rate G (compressor flow rate G) of the refrigerant discharged from the radiator 2 and the receiver 2*a*.

The flow distributor 8 is, for example, made of the same material as the refrigerant pipes, such as aluminum. The flow distributor 8 is, for example, formed by cutting an aluminum block member, die casting of aluminum, forging or the like. Alternatively, the flow distributor 8 can be made of another material, such as brass, copper, or the like. The refrigerant pipes are bonded to the flow distributor 8 such as by brazing to be in communication with the first passage 81 and the second passage 82, respectively.

The first passage 81 is in communication with the ejector 5 through the refrigerant pipe. The ejector 5 serves as a decompressing device for decompressing refrigerant as well as a refrigerant circulating device (fluid transportation device) for circulating refrigerant by means of a suction effect (dragging effect) generated by a refrigerant jet flow at high velocity.

The ejector 5 has a nozzle portion 5*a* and a suction portion 5*b*. The nozzle portion 5*a* draws the refrigerant passing through the first passage 81. In the nozzle portion 5*a*, a passage area (sectional area) of a refrigerant passage is throttled to convert pressure energy of the refrigerant into velocity energy, thereby to isoentropically decompress and expand the refrigerant. The suction portion 5*b* is disposed to be in communication with a jet port of the nozzle portion 5*a*. The suction portion 5*b* draws the gas-phase refrigerant from the second evaporator 7.

Further, the ejector 5 has a pressure-increase portion 5*c* downstream of the nozzle portion 5*a* and the suction portion 5*b*. In the pressure-increase portion 5*c*, the high velocity refrigerant jetted from the nozzle portion 5*a* and the refrigerant drawn from the suction portion 5*b* are mixed with each other. The mixed refrigerant is reduced in velocity, and the velocity energy is converted into pressure energy, thereby to increase the refrigerant in pressure. The pressure-increase portion 5*c* has a diffuser shape in which a passage area (sectional area) of a refrigerant passage gradually increases so as to achieve a pressure-increase function.

The first evaporator 6 is disposed downstream of the pressure-increase portion 5*c* with respect to the flow of refrigerant. The first evaporator 6 is a heat exchanger, such as a heat absorber, which evaporates the refrigerant flowing inside of the first evaporator 6 by absorbing heat of air (outside air) flowing outside of the first evaporator 6. The air is forcibly applied to the first evaporator 6. A refrigerant outlet of the first evaporator 6 is in communication with a suction side of the compressor 1 through the refrigerant pipe.

The suction passage 9 is provided by a pipe that extends from the second passage 82 of the flow distributor 8 and connects to the suction portion 5*b* of the ejector 5. The second throttle device 4 is disposed on the suction passage 9. Also, the second evaporator 7 is disposed on the suction passage 9 downstream of the second throttle device 4.

The second throttle device 4 is, for example, a capillary tube and serves to control the flow rate of refrigerant flowing into the second evaporator 7 and decompress the refrigerant. For example, the capillary tube is provided by a spiral tubule. Alternatively, the second throttle device 4 can be constructed of a fixed throttle such as an orifice or the like.

The second evaporator 7 is a heat exchanger, such as a heat absorber, which evaporates the refrigerant flowing inside of the second evaporator 7 by absorbing heat of the air (outside air) flowing outside of the second evaporator 7. The air is forcibly applied to the second evaporator 7. The second evaporator 7 is located downstream of the first evaporator 6 with respect to the flow of the air. Thus, the first evaporator 6 and the second evaporator 7 are arranged in series with respect to the flow of the air.

The control unit (not shown) is constructed of a microcomputer including a CPU, a ROM, a RAM and the like and its peripheral circuits. The control unit is configured to receive various manipulation signals outputted from an operation panel of the vehicle in accordance with manipulation of various switches on the operation panel, such as an air conditioner operation switch, a temperature setting switch and the like and various detection signals outputted from various sensors. The control unit executes various computations and processing in accordance with control programs stored in the ROM using the manipulation signals and the detection signals to control operations of various devices including the compressor 1.

Next, an operation of the present embodiment will be described with reference to FIGS. 1 to 5. When the manipulations signals are inputted to the control unit in accordance with operations of the air conditioner switch, the temperature setting switch and the like, the electromagnetic clutch of the compressor 1 is electrically conducted in accordance with a control signal outputted from the control unit. Thus, the electromagnetic clutch becomes in a connected state, and the driving force from the engine is transmitted to the compressor 1.

When a control current (control signal) is outputted from the control unit to the electromagnetic capacity control valve of the compressor 1 based on the control program, the discharge capacity of the compressor 1 is controlled. Thus, the compressor 1 draws the gas-phase refrigerant from the first evaporator 6 and compresses the refrigerant therein. Then, the compressor 1 discharges the high temperature, high pressure refrigerant toward the radiator 2.

In the radiator 2, the high temperature, high pressure refrigerant is condensed by being cooled by the outside air. The high pressure refrigerant, which has been cooled by the radiator 2, flows in the receiver 2*a*. In the receiver 2*a*, the refrigerant is separated into the gas-phase refrigerant and the liquid-phase refrigerant.

The liquid-phase refrigerant flowing out from the receiver 2*a* is decompressed and expanded to a predetermined pressure by the expansion valve 3, and thus becomes the gas and liquid two-phase refrigerant. The gas and liquid two-phase refrigerant flows in the flow distributor 8. In the flow distributor 8, the refrigerant is separated into the a first flow passing through the first passage 81 toward the ejector 5 and a second flow passing through the second passage 82 toward the capillary tube 4 at appropriate flow rates.

The refrigerant passing through the first passage 81 flows in the nozzle portion 5*a* of the ejector 5. In the nozzle portion 5*a*, the refrigerant is decompressed and expanded. Since the pressure energy of the refrigerant is converted into the velocity energy while the refrigerant is being decompressed and expanded, the refrigerant is jetted from the jet port of the nozzle portion 5*a* at high velocity. By the jet flow of the refrigerant, the suction force is generated. Thus, the refrigerant passing through the second evaporator 7 is drawn to the suction portion 5*b*.

The refrigerant jetted from the nozzle portion 5*a* and the refrigerant drawn to the suction portion 5*b* flow in the pressure-increase portion 5*c*, which is located downstream of the nozzle portion 5*a*. In the pressure-increase portion 5*c*, the velocity energy of the refrigerant is converted into the pressure energy due to the passage area being increased. Therefore, the refrigerant is increased in pressure.

The refrigerant discharged from the pressure-increase portion 5*c* flows in the first evaporator 6. In the first evaporator 6, the low pressure refrigerant absorbs heat from the air, and thus evaporates. In other words, the air is cooled by the refrigerant while passing through the first evaporator 6. The refrigerant discharged from the first evaporator 6 is drawn to the compressor 1 and compressed again.

The refrigerant passing through the second passage 82 of the flow distributor 8 flows in the capillary tube 4 through the suction passage 9. In the capillary tube 4, the refrigerant is decompressed into a low pressure refrigerant. The low pressure refrigerant flows in the second evaporator 7.

In the second evaporator 7, the low pressure refrigerant absorbs heat from the air, which has been cooled through the first evaporator 6, and thus evaporates. In other words, the air is further cooled while passing through the second evaporator 7.

The refrigerant, which has been evaporated in the second evaporator 7, is drawn into the suction portion 5*b* of the ejector 5, mixed with the liquid-phase refrigerant passing through the nozzle portion 5*a*, and then conducted to the first evaporator 6.

Figure 2:
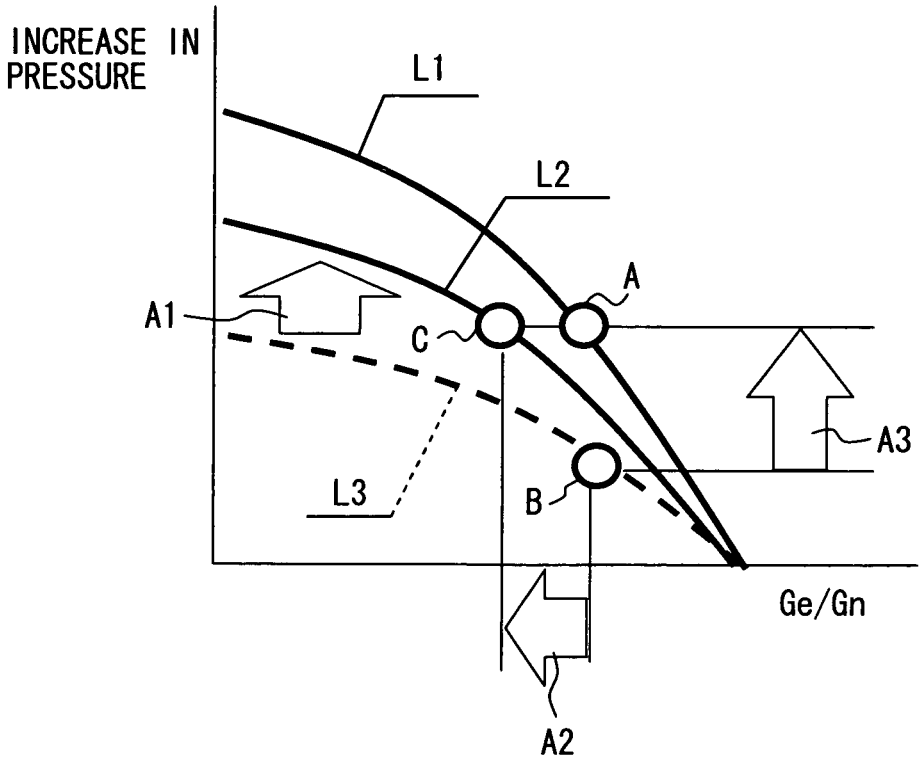
FIG. 2 is a graph showing an increase in pressure by an ejector in a low load condition of the refrigerating cycle apparatus according to the first embodiment.
Figure 4:
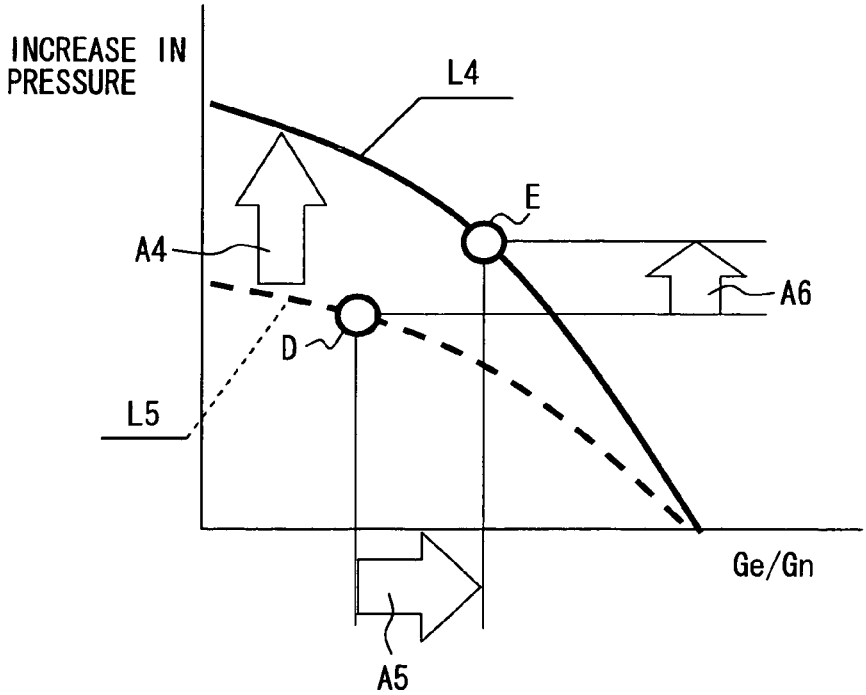
FIG. 4 is a graph showing an increase in pressure by the ejector in an ultra-high load condition of the refrigerating cycle apparatus according to the first embodiment.

Here, the flow rate of the refrigerant flowing in the nozzle portion 5*a* is defined as the nozzle flow rate Gn, and the flow rate of the refrigerant flowing in the suction portion 5*b* is defined as the suction flow rate Ge. In the ejector 5, the increase in pressure of the refrigerant increases as a ratio of the suction flow rate Ge to the nozzle flow rate Gn (hereinafter, the flow rate ratio Ge/Gn) reduces, as shown in FIGS. 2 and 4.

When the refrigerating cycle apparatus is in a high load condition where a heat load, such as a heat radiation load of the radiator 2 or a heat absorption load of the first and second evaporators 6, 7, is a predetermined load, such as in summer, a required refrigerating capacity is generally high. Thus, the compressor flow rate G discharged from the compressor 1 is increased. With this, the nozzle flow rate Gn supplied to the nozzle portion 5*a* from the first passage 81 is increased. Therefore, the nozzle efficiency is maintained to a high level and the ejector efficiency is improved. Hereinafter, the heat radiation load of the radiator 2 and the heat absorption load of the first and second evaporator 6, 7 are generally referred to as the heat load.

Figure 3:
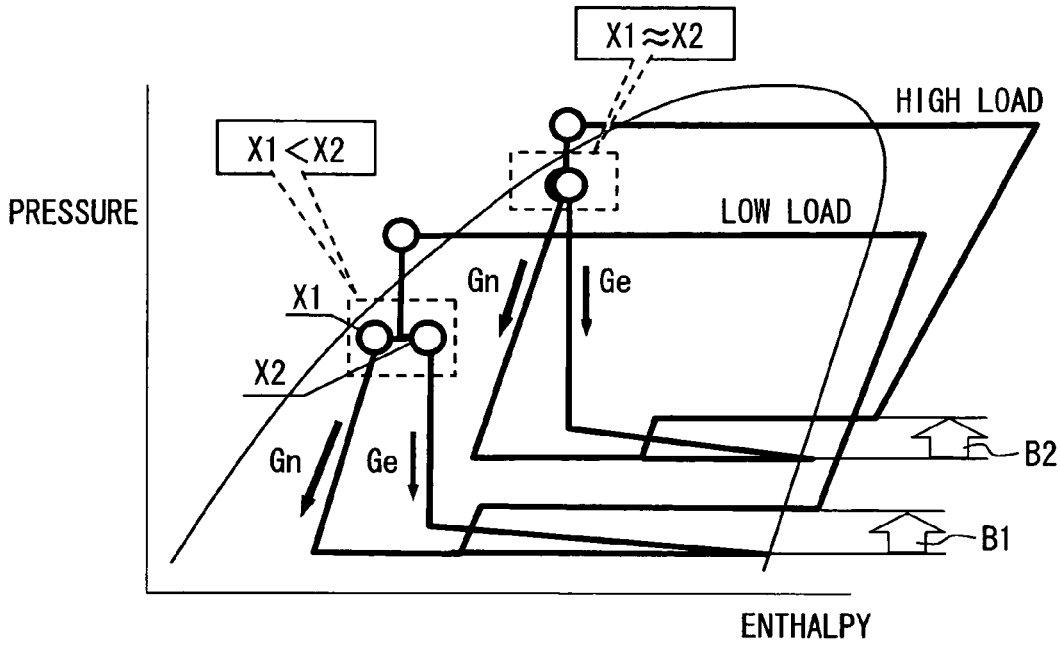
FIG. 3 is a graph showing operations of the refrigerating cycle apparatus in the low load condition and a high-load condition according to the first embodiment.

Specifically, as shown in FIG. 3, it is adjusted such that dryness X1 of the refrigerant passing through the first passage 81 (hereinafter, referred to as nozzle inlet dryness X1) and dryness X2 of the refrigerant passing through the second passage 82 (hereinafter, referred to as capillary inlet dryness X2) are substantially the same. As a result, the increase in pressure by the ejector 5 is ensured as shown by a point A in FIG. 2. Accordingly, the effect of improvement of the COP of the refrigerating cycle apparatus is maintained to a high level. In FIG. 2, a solid line L1 represents the increase in pressure in the high load condition.

When the refrigerating cycle apparatus is in a low load condition where the heat load is lower than the predetermined load, such as in spring and winter, the required refrigerating capacity is generally low. Thus, the compressor flow rate G is reduced, and thus the nozzle flow rate Gn is reduced. With this, the increase in pressure by the ejector 5 is low, as shown by a point B in FIG. 2. As a result, it is difficult to achieve the effect of improvement of the COP as in the high load condition. In FIG. 2, a dotted line L3 represents the increase in pressure in the low load condition of a refrigerating cycle apparatus without having the flow distributor 8 of the present embodiment.

In the present embodiment, the flow distributor 8 is capable of adjusting the flow rate ratio of the refrigerant into the first passage 81 and the second passage 82 in accordance with the heat load. Therefore, even in the low load condition, the effect of improvement of the COP is achieved as follows.

In the low load condition, as shown in FIG. 3, the flow distributor 8 provides higher priority to supply the liquid-phase refrigerant to the first passage 81 than the second passage 82 by the inertial force, the centrifugal force, the gravity and the like of the refrigerant in accordance with the decrease in the compressor flow rate G. For example, the nozzle inlet dryness X1 is adjusted to be smaller than the capillary inlet dryness X2 by the flow distributor 8.

Thus, the flow rate of the liquid-phase refrigerant toward the nozzle portion 5*a* is increased to increase input energy of the ejector 5, as shown by an arrow A1 in FIG. 2. With this, the flow ratio Ge/Gn is reduced as shown by an arrow A2 in FIG. 2, and the increase in pressure is increased as shown by an arrow A3 and a point C in FIG. 2. Accordingly, in the low load condition, the ejector efficiency is maintained to a high level, and the increase in pressure by the ejector 5 is ensured, for example, substantially similar to the increase in pressure in the high load condition, as shown by arrows B1, B2 in FIG. 3. Further, the COP of the refrigerating cycle apparatus is improved. In FIG. 2, a solid line L2 represents the increase in pressure in the low load condition of the refrigerating cycle apparatus of the present embodiment.

Next, an operation in an ultra-high load condition where the heat load is higher than the predetermined load will be described with reference to FIGS. 4 and 5. In the ultra-high load condition, the compressor flow rate G of the refrigerant circulating through the refrigerating cycle apparatus is excessively increased. If the nozzle flow rate Gn is excessively increased, expansion of the refrigerant in the nozzle portion 5*a* becomes insufficient, resulting in a decrease in the efficiency of the nozzle portion 5*a*.

Therefore, the amount of energy recovery is reduced, and thus the input energy in the ejector 5 is reduced and the increase in pressure in the ejector 5 is reduced, as shown by a point D in FIG. 4. In FIG. 4, a dashed line L5 represents the increase in pressure in a refrigerating cycle apparatus without having the flow distributor 8 of the present embodiment.

Figure 5:
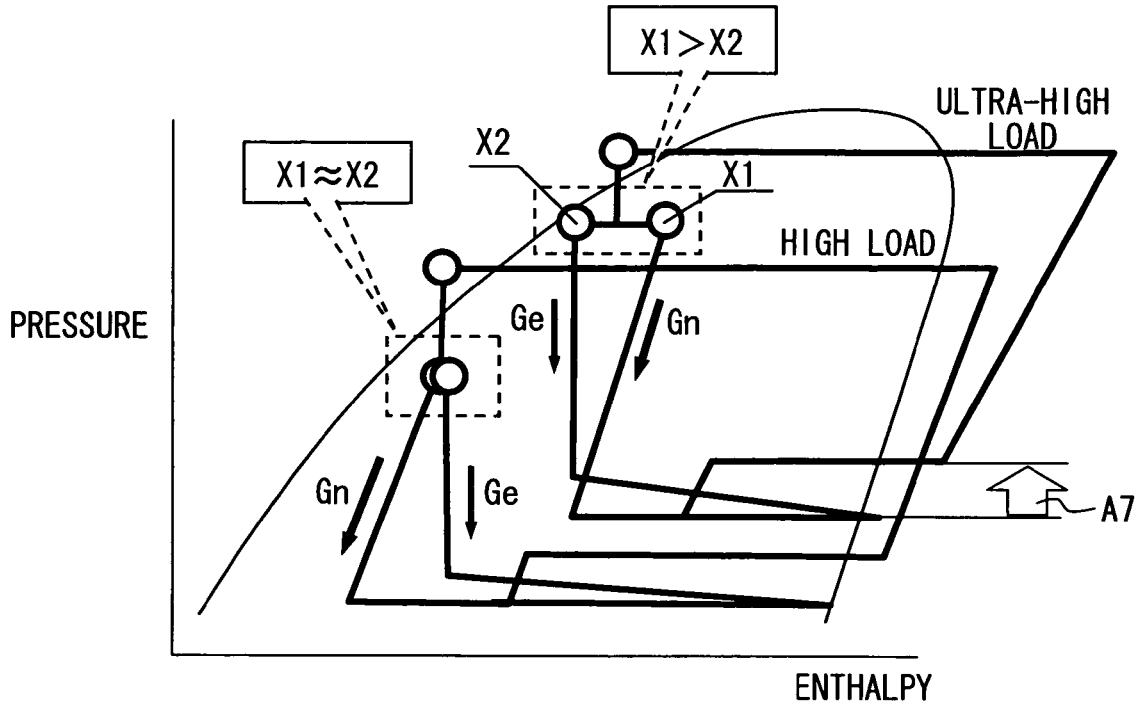
FIG. 5 is a graph showing operations of the refrigerating cycle apparatus in the high load condition and the ultra-high load condition according to the first embodiment.
Figure 6A:
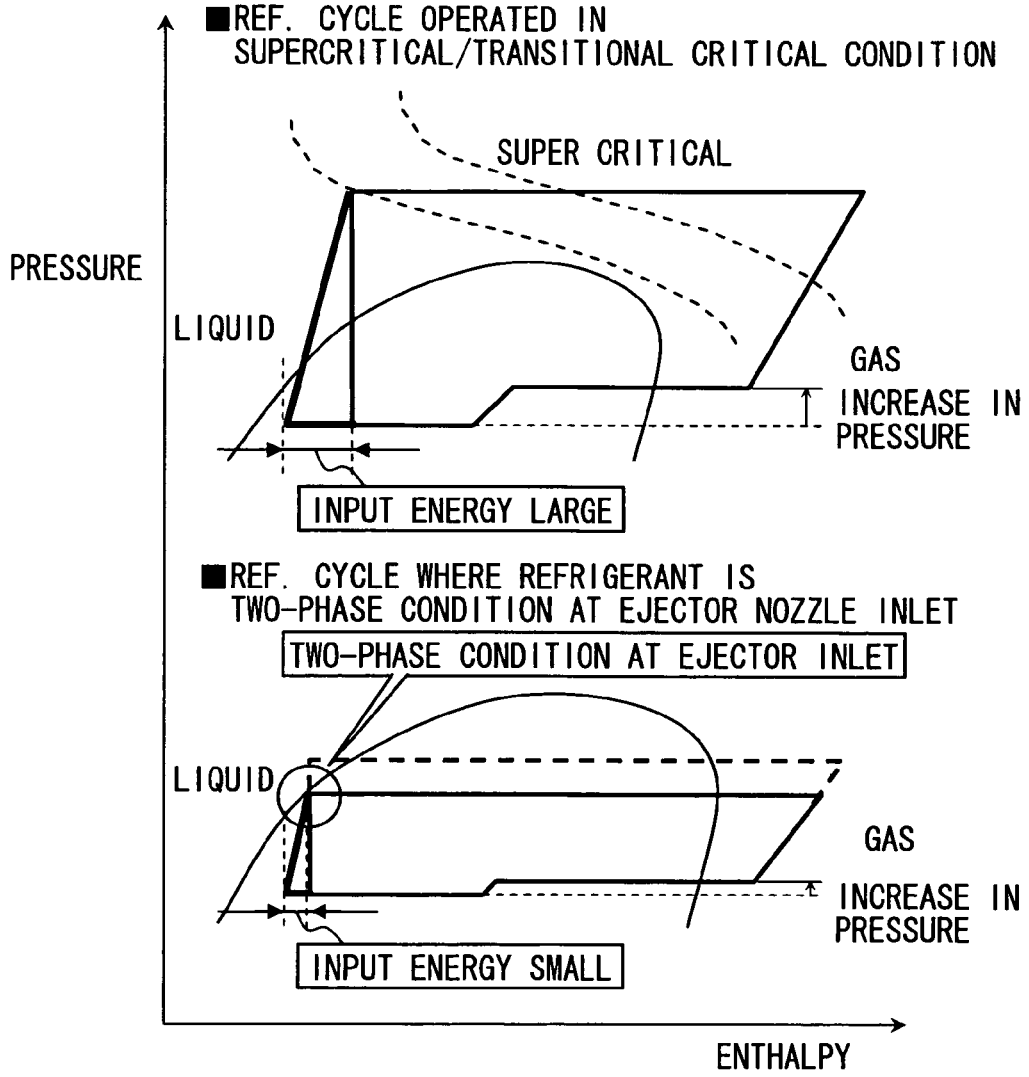
FIG. 6A RELATED ART
FIG. 6A is a graph showing an operation of a refrigerating cycle apparatus operated in a supercritical condition and an operation of a refrigerating cycle apparatus operated in a gas and liquid two-phase condition according to a related art.
Figure 6B:
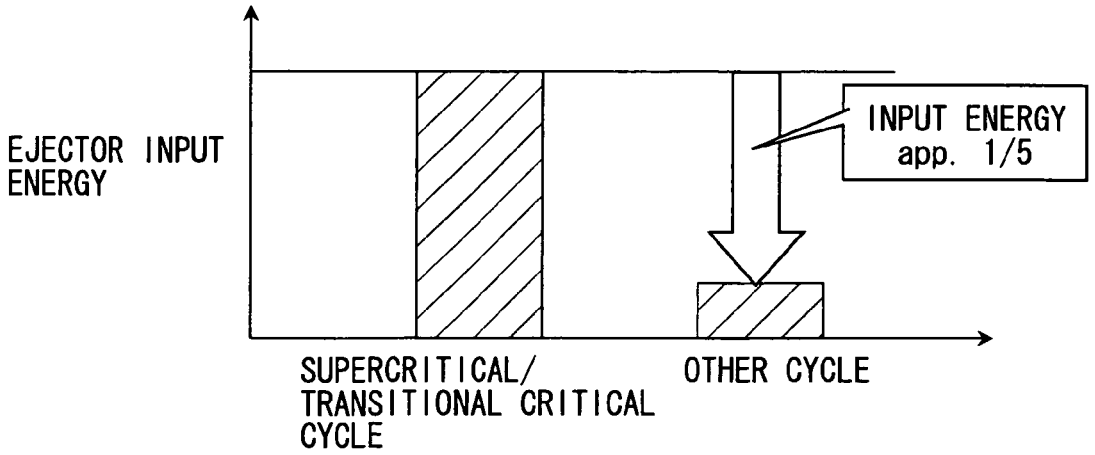
FIG. 6B RELATED ART
FIG. 6B is a graph showing an input energy at an inlet of a nozzle portion of an ejector according to the related art.

In the present embodiment, therefore, the flow distributor 8 reduces the flow rate of the liquid refrigerant passing through the first passage 81 in accordance with an increase in the compressor flow rate G in the ultra-high load condition, as shown in FIG. 5. Specifically, the flow distributor 8 reduces the flow rate of the liquid refrigerant flowing toward the nozzle portion 5*a* by increasing the nozzle inlet dryness X1 larger than the capillary inlet dryness X2, so that the refrigerant is properly expanded in the nozzle portion 5*a*.

Thus, the efficiency of the nozzle portion 5*a* improves, and further the input energy increases, as shown by an arrow A4 in FIG. 4. In such a case, the flow ratio Ge/Gn is increased, conversely from the low load condition, as shown by an arrow A5 in FIG. 4. Accordingly, in the ultra-high load condition, although the flow ratio Ge/Gn increases, the nozzle efficiency is improved and the input energy is increased by adjusting the nozzle inlet dryness X1 larger than the capillary inlet dryness X2. Further, the increase in pressure is increased to the point E even in the ultra-high load condition in accordance with the improvement of the nozzle efficiency, as shown by an arrow A6 in FIG. 4 and an arrow A7 in FIG. 5. Accordingly, the COP of the refrigerating cycle apparatus is improved. In FIG. 4, a solid line L4 represents the increase in pressure in the ultra-high load condition of the refrigerating cycle apparatus of the present embodiment.

(Second Embodiment)

A second embodiment of the present invention will be hereinafter described.

In the first embodiment, the expansion valve 3, the capillary tube 4, the ejector 5, the first evaporator 6 and the flow distributor 8 are separately disposed from one another, but can be integrated as follows.

For example, the flow distributor 8 can be integrated with the expansion valve 3. As another example, the flow distributor 8 and the capillary tube 4 can be integrated with each other. As further another example, the flow distributor 8 and the ejector 5 can be integrated with each other. In such cases, devices around the flow distributor 8 are reduced in size. Therefore, mountability of the refrigerating cycle apparatus to the vehicle improves.

Further, the flow distributor 8, the ejector 5 and the first evaporator 6 can be integrated with each other. In such a case, since the first evaporator 6 is provided as a base device, individual spaces for mounting the flow distributor 8 and the ejector 5 are reduced. Further, assembling steps of assembling the flow distributor 8 and the ejector 5 are reduced. Accordingly, the mountability of the refrigerating cycle apparatus to the vehicle further improves.

(Other Embodiments)

The various exemplary embodiments of the present invention are described hereinabove. However, the present invention is not limited to the above described exemplary embodiments, but may be implemented in various other ways without departing from the spirit of the invention.

For example, the vapor compression refrigerating cycle apparatus of the above embodiments can be employed to a heat pump cycle of an interior air conditioner or a hot-water supplying apparatus intended for house use, instead of the vehicle air conditioner.

The compressor 1 is not limited to the swash plate compressor, but can be a fixed capacity compressor, such as a scroll-type compressor or a rotary-type compressor.

Further, an accumulator can be provided on a discharge side of the first evaporator 6, in place of the receiver 2*a*. The first throttling device 3 is not limited to the expansion valve 3, but can be an electric flow control valve or a fixed flow rate control valve.

The ejector 5 can be a flow rate variable ejector, which is capable of varying the passage area of the nozzle portion.

The refrigerant is not limited to a specific refrigerant, but may be a chlorofluorocarbon base refrigerant, HC base refrigerant, carbon dioxide and the like. In such a case, the refrigerant cycle apparatus can be employed as a supercritical cycle and a subcritical cycle, in addition to a general cycle.

Additional advantages and modifications will readily occur to those skilled in the art. The invention in its broader term is therefore not limited to the specific details, representative apparatus, and illustrative examples shown and described.

What is claimed is:

1. A vapor compression refrigerating cycle apparatus comprising:

a compressor drawing and compressing refrigerant;

a radiator radiating heat of high-pressure refrigerant discharged from the compressor;

a first throttle device decompressing refrigerant discharged from the radiator into gas and liquid phase refrigerant;

a flow distributor that includes a base passage extending in an extending direction in communication with the first throttle device, a first passage in direct communication with the base passage that continuously extends from a downstream end of the base passage, a second passage in direct communication with the base passage that continuously extends from the base passage at a position upstream from the downstream end of the base passage, the second passage extending in a direction different from the extending direction of the base passage, the flow distributor separating the gas and liquid phase refrigerant discharged from the first throttle device into the first passage and the second passage;

an ejector that includes a nozzle portion, a suction portion and a pressure-increase portion, the nozzle portion being in communication with the first passage and decompressing and expanding refrigerant passing through the first passage, the suction portion drawing refrigerant by a jet flow of refrigerant from the nozzle portion, the pressure-increase portion mixing refrigerant drawn from the suction portion with the refrigerant jetted from the nozzle portion to increase pressure of refrigerant;

a first evaporator evaporating refrigerant discharged from the ejector and discharging evaporated refrigerant toward the compressor;

a suction passage extending from the second passage to the suction portion of the ejector;

a second throttle device disposed on the suction passage, the second throttle device decompressing and expanding refrigerant passing through the suction passage; and a second evaporator disposed on the suction passage downstream of the second throttle device, the second evaporator evaporating the refrigerant passing through the suction passage, wherein the flow distributor adjusts a ratio of a flow rate of refrigerant passing through the second passage to a flow rate of refrigerant passing through the first passage in accordance with a heat load of at least one of the radiator, the first evaporator and the second evaporator, the flow distributor adjusts dryness of the refrigerant passing through the first passage to be smaller than dryness of the refrigerant passing through the second passage in a first load condition where the heat load is lower than a predetermined load, the flow distributor adjusts the dryness of the refrigerant passing through the first passage to be larger than the dryness of the refrigerant passing through the second passage in a second load condition where the heat load is higher than the predetermined load;

the first load condition is a condition where a flow rate of refrigerant discharged from the compressor is lower than a predetermined rate; and the second load condition is a condition where the flow rate of refrigerant discharged from the compressor is higher than the predetermined rate.

2. The vapor compression refrigerating cycle apparatus according to claim 1, wherein the flow distributor is integrated with the ejector.

3. The vapor compression refrigerating cycle apparatus according to claim 1, wherein the flow distributor is integrated with the first throttle device.

4. The vapor compression refrigerating cycle apparatus according to claim 1, wherein the flow distributor is integrated with the second throttle device.

5. The vapor compression refrigerating cycle apparatus according to claim 1, wherein the flow distributor and the ejector are integrated with the first evaporator.

6. The vapor compression refrigerating cycle apparatus according to claim 1, wherein the base passage extends in an up and down direction, an upper end of the base passage is in communication with the first throttle device, the first passage extends from a lower end of the base passage in a horizontal direction, and the second passage extends in the horizontal direction from a portion of the base passage, the portion being located between the upper end and the lower end.

7. The vapor compression refrigerating cycle apparatus according to claim 6, wherein the flow distributor adjusts the ratio by means of at least one of an inertial force, a centrifugal force and gravity of the refrigerant.

8. The vapor compression refrigerating cycle apparatus according to claim 1, wherein the flow distributor adjusts the ratio by means of at least one of an inertial force, a centrifugal force and gravity of the refrigerant.

9. The vapor compression refrigerant cycle apparatus according to claim 1, wherein the first load condition and the second load condition occur during a cooling cycle.

10. The vapor compression refrigerating cycle apparatus according to claim 1, wherein the base passage extends continuously between an inlet at an upstream end of the base passage and an outlet at the downstream end of the base passage, the first passage is directly connected to the outlet of the base passage, the position upstream from the downstream end of the base passage being between the inlet and the outlet.

11. The vapor compression refrigerating cycle apparatus according to claim 1, wherein the refrigerant flow through the base passage is only in the extending direction of the base passage.

12. A vapor compression refrigerating cycle apparatus comprising:

a variable capacity compressor drawing and compressing refrigerant;

a radiator radiating heat of high-pressure refrigerant discharged from the compressor;

a first throttle device decompressing refrigerant discharged from the radiator into gas and liquid phase refrigerant;

a flow distributor that includes base passage extending in an extending direction in communication with the first throttle device, a first passage in direct communication with the base passage that continuously extends from a downstream end of the base passage, a second passage in direct communication with the base passage that continuously extends from the base passage at a position upstream from the downstream end of the base passage, the second passage extending in a direction different from the extending direction of the base passage, the flow distributor separating the gas and liquid phase refrigerant discharged from the first throttle device into the first passage and the second passage;

an ejector that includes a nozzle portion, a suction portion and a pressure-increase portion, the nozzle portion being in communication with the first passage and decompressing and expanding refrigerant passing through the first passage, the suction portion drawing refrigerant by a jet flow of refrigerant from the nozzle portion, the pressure-increase portion mixing refrigerant drawn from the suction portion with the refrigerant jetted from the nozzle portion to increase pressure of refrigerant;

a first evaporator evaporating refrigerant discharged from the ejector and discharging evaporated refrigerant toward the compressor;

a suction passage extending from the second passage to the suction portion of the ejector;

a second throttle device disposed on the suction passage, the second throttle device decompressing and expanding refrigerant passing through the suction passage; and a second evaporator disposed on the suction passage downstream of the second throttle device, the second evaporator evaporating the refrigerant passing through the suction passage, wherein the flow distributor adjusts a ratio of a flow rate of refrigerant passing through the second passage to a flow rate of refrigerant passing through the first passage in accordance with a heat load of at least one of the radiator, the first evaporator and the second evaporator, the flow distributor adjusts dryness of the refrigerant passing through the first passage to be smaller than dryness of the refrigerant passing through the second passage in a first load condition when the compressor operates at a first percentage of capacity, and the flow distributor adjusts the dryness of the refrigerant passing through the first passage to be larger than the dryness of the refrigerant passing through the second passage in a second load condition when the compressor operates at a second percentage of capacity higher than the first percentage of capacity.

13. The vapor compression refrigerating cycle apparatus according to claim 12, further comprising a receiver disposed between the radiator and the first throttle device, the receiver separating the refrigerant discharged from the radiator into a gas-phase refrigerant and a liquid-phase refrigerant, only the liquid-phase refrigerant being discharged from the receiver to the first throttle device.

14. The vapor compression refrigerating cycle apparatus according to claim 12, wherein the first throttle device is a temperature sensing-type throttle device in which an opening degree of a valve is controlled in accordance with a temperature of refrigerant discharged from the first evaporater.

15. The vapor compression refrigerant cycle apparatus according to claim 12, wherein the first load condition and the second load condition occur during a cooling cycle.

16. The vapor compression refrigerating cycle apparatus according to claim 12, wherein the base passage extends continuously between an inlet at an upstream end of the base passage and an outlet at the downstream end of the base passage, the first passage is directly connected to the outlet of the base passage, the position upstream from the downstream end of the base passage being between the inlet and the outlet.

17. The vapor compression refrigerating cycle apparatus according to claim 12, wherein the refrigerant flow through the base passage is only in the extending direction of the base passage.

* * * * *